US005312315A

United States Patent [19]

Mortensen et al.

[11] Patent Number: 5,312,315

[45] Date of Patent: May 17, 1994

[54] PNEUMATIC VARIABLE RESISTANCE REHABILITATION/THERAPY APPARATUS

[75] Inventors: Donald G. Mortensen, San Jose; Gary S. Fanton, Portola Valley, both of Calif.

[73] Assignee: Core Outpatient Services, Santa Clara, Calif.

[21] Appl. No.: 631,637

[22] Filed: Dec. 21, 1990

[51] Int. Cl.[5] ..... A63B 21/008; A63B 101/00; A63B 103/00

[52] U.S. Cl. ..... 482/113; 482/135; 482/148

[58] Field of Search ..... 482/96, 113, 135, 148; 60/407, 418

[56] References Cited

U.S. PATENT DOCUMENTS

| | | | |
|---|---|---|---|
| 1,996,350 | 4/1935 | Schaff | 482/96 |
| 3,369,403 | 2/1968 | Carlin et al. | 482/113 |
| 3,387,843 | 6/1968 | Chandler | 482/113 |
| 4,257,593 | 3/1981 | Keiser . | |
| 4,397,462 | 8/1983 | Wilmarth . | |
| 4,756,669 | 7/1988 | Hata | 60/418 X |
| 4,865,315 | 9/1989 | Paterson et al. | 483/113 X |
| 4,884,802 | 12/1989 | Graham . | |
| 4,928,957 | 5/1990 | Lanier et al. | 482/113 X |

FOREIGN PATENT DOCUMENTS

| | | | |
|---|---|---|---|
| 0335616 | 10/1989 | European Pat. Off. . | |
| 3737643 | 6/1989 | Fed. Rep. of Germany . | |
| 2645032 | 10/1990 | France . | |
| 8807879 | 10/1988 | PCT Int'l Appl. | 482/113 |
| 2179560 | 3/1987 | United Kingdom | 482/135 |

*Primary Examiner*—Randall L. Green

*Assistant Examiner*—Mary Beth Jones

*Attorney, Agent, or Firm*—Jacques M. Dulin; Thomas C. Feix

[57] ABSTRACT

A pneumatic variable resistance rehabilitation/therapy apparatus for the balanced strengthening of musculature surrounding injured, weakened, and post-operative ligaments associated with the major joints of the lower extremities. In a preferred embodiment, a leg press machine is provided comprising a frame, a foot rest assembly including a foot rest pad, and a reciprocating carriage having a patient supporting bed surface thereon. A pneumatic circuit comprising a cylinder having a reciprocating piston therein, an accumulator, an air supply and a pressure regulator is provided for the variable progressive resistance against the movement of the carriage during the working stroke (where the patient straightens his/her leg(s)). The reciprocating piston rod is linked to the reciprocating carriage by a cable and pulley system to provide a longer and more physiologically tolerable working stroke. The accumulator volume, being roughly equal to the cylinder volume, supplements the system volume to provide a resistive force rate similar to a mechanical spring system. The rod end of the cylinder is also provided with a bleed valve to prevent plunger resistance due to vacuum effects during the working stroke, and a needle valve to control the return speed of the piston rod during the return stroke. An alternate embodiment provides for optional hand holds on both ends of the rehabilitation apparatus for rehabilitation of upper extremity related injuries such that the user may use either a pushing or pulling movement to complete an exercise cycle.

22 Claims, 5 Drawing Sheets 26
27
28
24
25
23
24
20
A
3
16
36
10
19
11
12
1
21
16
5
30
A
3
31
21
34
33

16
12
12a
10
11
26
27
25
19
14
24a
24
23
16
24a
13
21
20
21
22
21

5
21
44
36
80
82
31
81
33
30
5
38c
48
40
52
34

PNEUMATIC VARIABLE RESISTANCE REHABILITATION/THERAPY APPARATUS

FIELD

The present invention relates to a physical therapy and rehabilitation device as distinct from an exercise device. The therapy/rehabilitation device of this invention is particularly useful for ankle, knee and hip muscle strengthening, which minimizes undesirable ligament strains and joint reaction forces through an exercising stroke, allows for an exercising stroke that closely replicates the physiologic function of the lower extremity muscles and joints, and eliminate hazards encountered in the use of prior art exercising devices that are potentially harmful to postoperative or post-injury lower extremities.

BACKGROUND

A Wide variety of mechanical, hydraulic and pneumatic exercise devices are currently available. Typically these devices are for the strengthening of musculature, and may provide unilateral or bilateral action, and various types of resistive force both on the extension stroke and the return stroke. Most commercially available exercising devices possess characteristics that focus on maximizing efficiency of muscular contraction but create a risk of injury to the operator, because the principles of joint reaction forces and ligament strains induced by those muscular contractions have not been understood, or have been overlooked or ignored. The use of such devices may be significantly harmful when used in certain medically prescribed rehabilitation programs and strength training programs.

Most commercially available rehabilitation and exercising devices employ a stack of weights that provide resistance in stepwise amounts selected by the operator/user. They are typically arranged to provide resistance to one specific muscle group, for example the quadriceps muscle group on the front of the thigh. The amount of muscle force exerted to move the weight stack is not constant because more force is required to initiate weight movement (to overcome the inertia of rest) than to maintain motion (inertia of motion). Once the weight is put in motion, the changes in speed (acceleration) of the weight stack causes the resistance experienced by the user to change. Thus, as the weight is being accelerated, the resistive force required by the user to further move the weight is decreased rapidly compared to the initial resistive force experienced by the user when beginning to lift or move the weight. The resistive force, however, sharply increases as the movement of the weights is slowed or stopped. This would be the situation when the weights are fully lifted (full extension) or laid to rest (full return). Should the operator suddenly change the direction of applied force or magnitude of force, then higher than predicted stresses are generated across the muscle-tendon unit and the joint surfaces. This is harmful to healing ligaments or injured joint surfaces in the lower extremities.

One example of a mechanical leg exercise device is shown in Graham U.S. Pat. No. 4,884,802. In this mechanical system, in order to change the resistive force, bungee cords must be added or removed from the system. In addition, there is extremely fast rebound because there is nothing to slow the carriage upon return to the rest position. The user in an exercise mode may not experience any discomfort because the muscles are sufficiently strong to stand the rebound shock. However, for a person involved in rehabilitation, such as knee surgery to repair torn ligaments (e.g., anterior cruciate ligament) or patellar surgery, the rebound shock could be significant enough to delay rehabilitation or cause further damage.

Some prior art devices have sought to overcome the variations in muscle forces that occurs throughout the exercise stroke by offering constant resistance devices. These include various types of pneumatic, hydraulic, or motorized resistance mechanisms to dampen the "peaks" and "valleys" of the forces generated during the exercise stroke such as present in the Graham bungee cord sled device.

There is a fundamental difference, however, between hydraulic systems and pneumatic systems. Hydraulic systems involve applying force to a piston which expresses a non-compressive fluid out through a control orifice. These devices tend to be force dependent/rate independent. That is, in order to achieve a certain number of strokes per minute, the force required to express fluid through a given orifice size must be increased. They do not permit easy change of "reps" (i.e., repetitions per minute). The force applied throughout the entire stroke must be relatively constant. Further, once the pressure is released, the system, unless it is a "gravity down" system, will not return to the original rest position. Some systems are bi-acting, that is, the valve is a two way valve rather than a check valve and fluid is merely expressed from one side of a piston to the other and back again during the exercise action so that force must be applied in both strokes. A further disadvantage to hydraulic systems is that the fluid tends to leak from the hydraulic cylinder after a while creating damage to floor covering or a slip hazard around the equipment. A typical example of a hydraulic exercise device would be a hydraulic rowing machine.

Pneumatic systems work against a compressible fluid, air. If they leak, the fluid does not damage the equipment or surrounding area. Upon piston compression of the air, the piston will rebound by the energy that is stored in the compressed air where the air is compressed in a sealed chamber. A variety of exercise devices propose to use accumulators or reservoirs which are in addition to the compressive piston cylinder so that the volume of the gas to be compressed may be varied to provide a variable resistance to the system.

Examples of non-rehabilitative pneumatic exercise devices are shown in Wilmarth (U.S. Pat. No. 4,397,462) and in Keiser (U.S. Pat. No. 4,257,593). Both of these devices are simulants of weight lifting devices for the shoulder and arm musculature. They comprise a horizontal bench and a vertical stand from which is pivoted one or more lever arms which actuate a piston as the source of the pneumatic resistance. Wilmarth calls for a 30-1 volume ratio between his cylinder and his accumulator.

Keiser calls for the use of a pair of interconnecting reservoirs which contain a liquid, the level of which can be adjusted to adjust the air volume through a normally closed, complex valving system. The device is disclosed to be bi-lateral so that individual arms may be exercised independently of each other or may be operated 90 degrees out of phase.

Additionally, most prior art exercise devices are inappropriate for lower extremity rehabilitation in physical therapy programs because they require muscle groups to contract in an isolated manner (i.e. either the quadriceps or the hamstring muscle group contracts), rather than provide mechanisms which require opposing muscle groups to contract simultaneously, i.e. co-contraction of both the agonistic and antagonistic muscle groups. For example, both Wilmarth and Keiser are directed to exercising isolated muscle groups, one group at a time. They do not encourage co-contraction of opposing muscle groups during any part of the exercising stroke.

Finally, prior art devices such as Keiser U.S. Pat. No. 4,257,593 teach away from employing inertia of motion to the advantage of the user once movement is initiated. Both Keiser and Wilmarth involve gravity forces in their design and use.

Neither of the above cited prior art devices specifically address the problems faced by a user who has a fragile knee joint (or other damaged lower extremity condition) and who must strengthen the musculature and ligaments surrounding the weakened or injured area in a manner which does not further aggravate their condition. In the prior art devices, injury may occur because the forces are not reduced, or adjustable to the proper level selected by these devices, at joint positions at which the ligaments or cartilage surfaces are most susceptible to damage.

For example, the position of the knee during muscle contraction is very important in determining ligament and joint reaction forces. Patellofemoral joint pain, one of the most common musculoskeletal problems encountered in our active society, occurs because the stresses generated through tendons, soft tissues, bone, or cartilage surfaces often exceed their biologic tolerance. These stresses are highest when the muscle contraction or strain occurs in deep knee flexion (knee bent) and lowest when the knee is near terminal extension (knee straight). Since joint reaction forces on the patellofemoral joint are highest with the knee fully bent, low resistance would be needed to prevent injury at that end of the exercise stroke. A prior art constant resistance device set for that low level would not be effective beyond initial extension of the knee.

In another situation strains on commonly injured ligaments, most notably the anterior cruciate ligament, are highest when isolated quadriceps activity occurs when the knee is near extension (0 to 40 degrees). It is desirable to rehabilitate these injuries with the knee in flexion and to do so while simultaneously contracting both the quadricep and hamstring muscle groups (co-contraction).

A paradox exists, therefor, because rehabilitation of injured or repaired ligaments in flexion may be harmful to the patellofemoral joint, and rehabilitation of the patellofemoral joint in extension to prevent patellofemoral pain may be harmful to injured ligaments in the knee.

Accordingly there is a need in the art to provide a rehabilitation device for lower extremity injury or surgery patients which allows for simultaneous co-contraction of opposing muscle groups in order to replicate the physiological functions of concentric, eccentric, and closed kinetic chain exercises (i.e. to simulate the activities of running, climbing, jumping and squatting). There is also a need in the art for a rehabilitative device which also includes the ability to utilize momentum to enhance muscle rehabilitation and improve coordination and endurance that has features of variably-controlled resistance that respect tolerances of biological tissues at various joint angles during both the beginning (concentric) and ending (eccentric) phases of the exercising stroke so that injured or weakened joint surface is not subjected to harmful stresses at the critical stages of joint movement.

THE INVENTION

Objects

It is therefore an object of the invention to provide an improved pneumatic rehabilitation and physical therapy device to create resistance to muscular forces generated, e.g. by an upper or lower extremity of a patient operator.

It is another object of the invention to provide a rehabilitation device that operates in a gravity neutral horizontal plane and allows for movement of the body in such a manner that most closely replicates the normal physiology and function of work or sports related activities.

It is another object of the invention to provide a rehabilitation device that provides infinitely variable resistance settings, the force of which must be overcome by the operator, utilizing muscular contraction to initiate movement during the concentric stroke and at a speed which is determined by the effort of the operator.

It is another object of the invention to provide a rehabilitation device that provides a return or eccentric stroke against which the operator must work through muscular contraction, the rate of return being determined by the efforts of the operator and controlled by variable adjustment of the pneumatic pressure release.

It is another object of the invention to provide a rehabilitation device that allows simultaneous co-contraction of agonistic and antagonistic muscle groups about the hip, knee, and ankle.

It is another object of the invention to provide a rehabilitation device that allows the operator's neck and spine to remain in a neutral supported position throughout the exercising cycle and replicates the closed kinetic chain activities of the lower extremity required by patients with lower back or spinal injuries.

It is another object of the invention to provide a rehabilitation device that allows for the development of momentum such that the operator can replicate the physiologic function of hopping, running or jumping in a safe, well controlled setting.

It is another object of the invention to provide a rehabilitation device that is physiologically safe and well tolerated by the cartilage surfaces, muscles, tendon and ligaments of the foot, ankle, and knee joints and does not place unwanted stresses across injured or repaired ligaments or cartilage.

It is another object of the invention to provide a rehabilitation device that allows for instantaneous unilateral or bilateral operation by the operator with variable speed and resistance controllable by the operator, both in the extension and return strokes, by selecting the desired pneumatic pressure against which the muscular force is to be applied.

It is another object of the invention to provide a rehabilitation device that is durable and cost effective to be used in a rehabilitation or physical therapy setting.

It is another object of the invention to provide a rehabilitation device that employs safety features of controlled rebound, smooth operation, and easily controlled levels of resistance to minimize the risk of injury to the patient operator/user.

It is another object of the invention to provide a rehabilitation device that can utilize additional add-on components that will monitor or calculate the individual efforts of the patient operator, including repetitions, time of exercise, work and calories expended, amount of extremity force generated, and other such features deemed appropriate or necessary in evaluation of the rehabilitation process.

Still other objects will be evident from the summary, drawings and detailed specification which follows.

DRAWINGS

Figure 3:
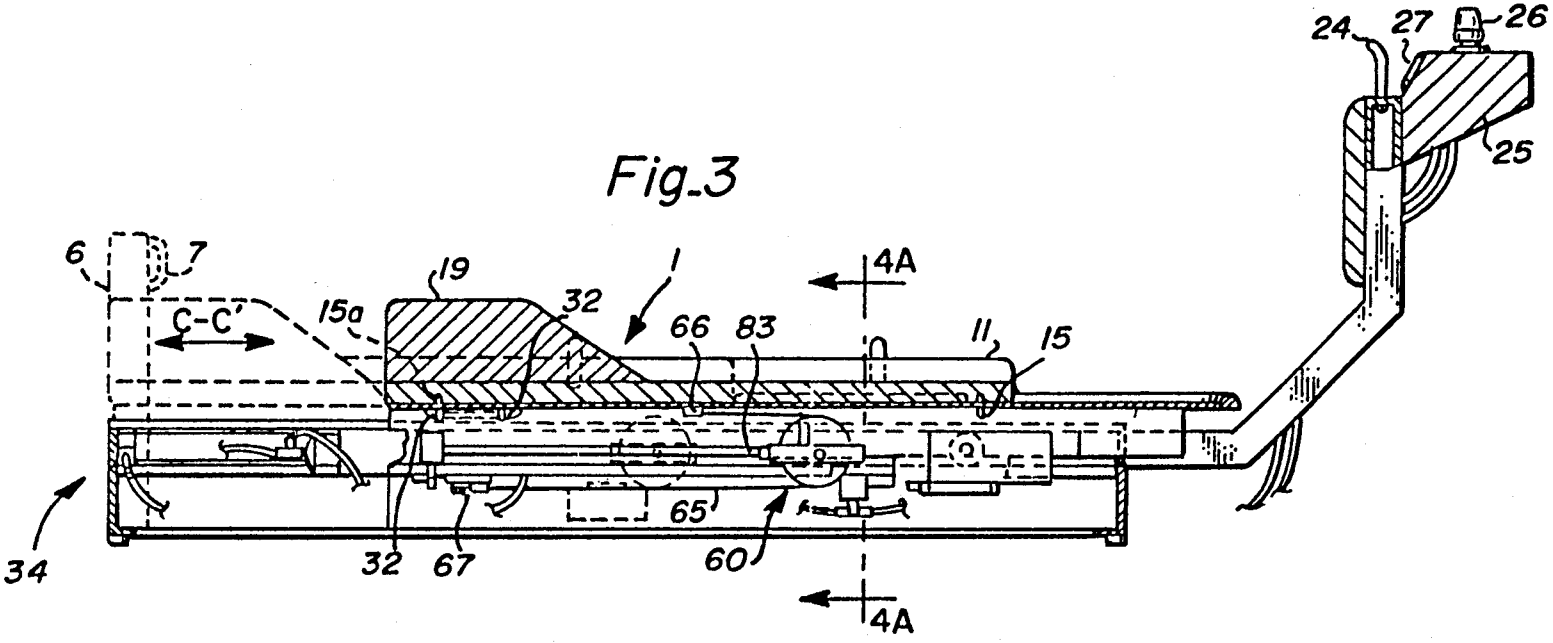
FIG. 3 is a right side elevation view in partial cross-section showing the relative movement of the carriage assembly with respect to the frame assembly of the rehabilitation apparatus.
Figure 5:
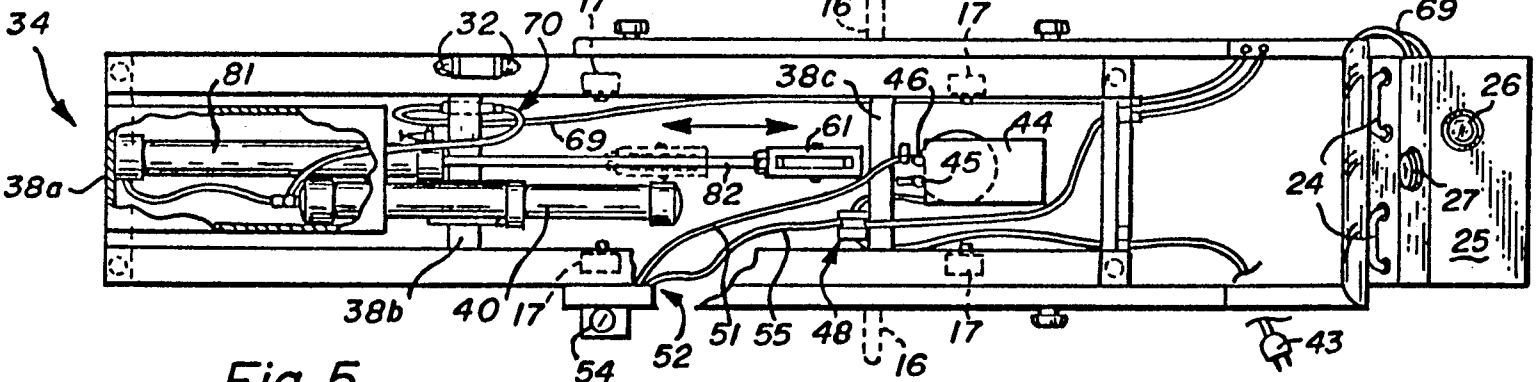
Figure 4A:
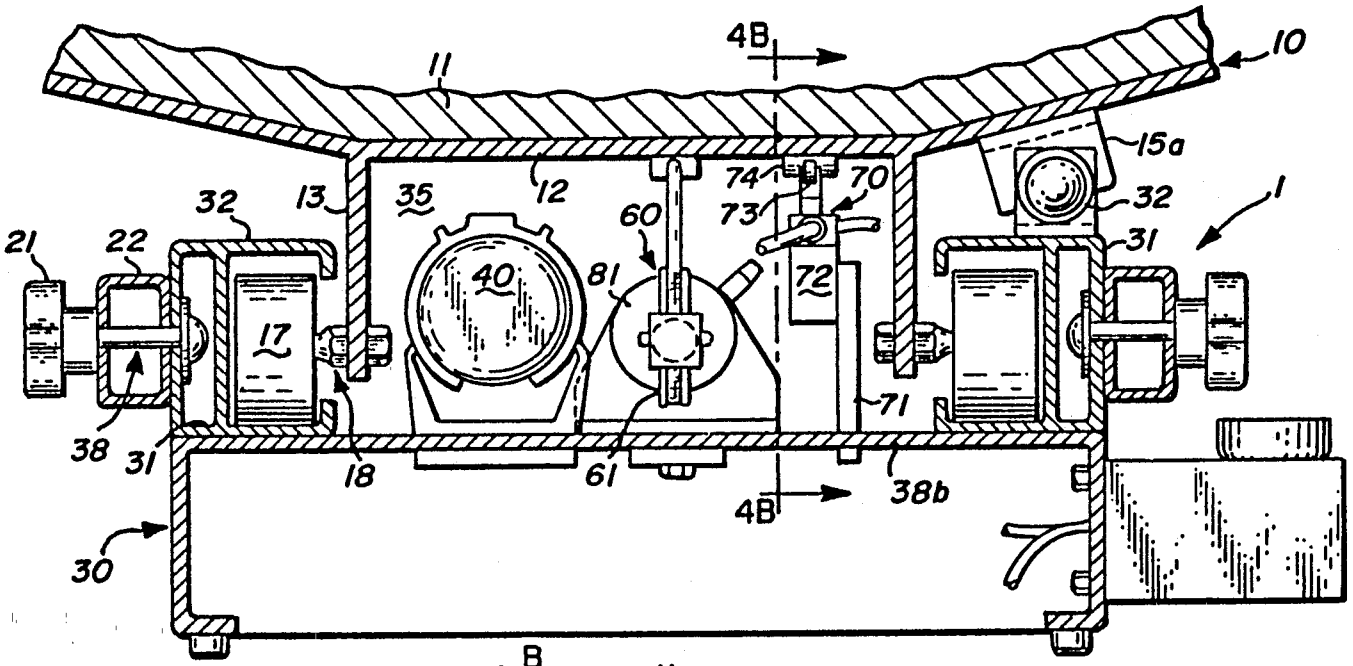
Figure 4B:
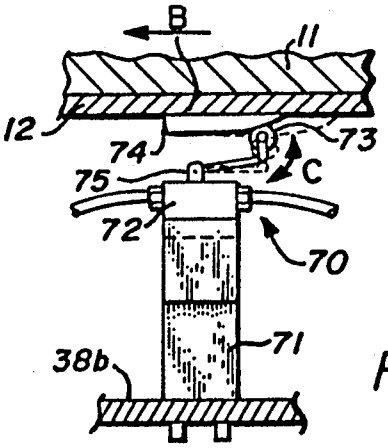
Figure 6:
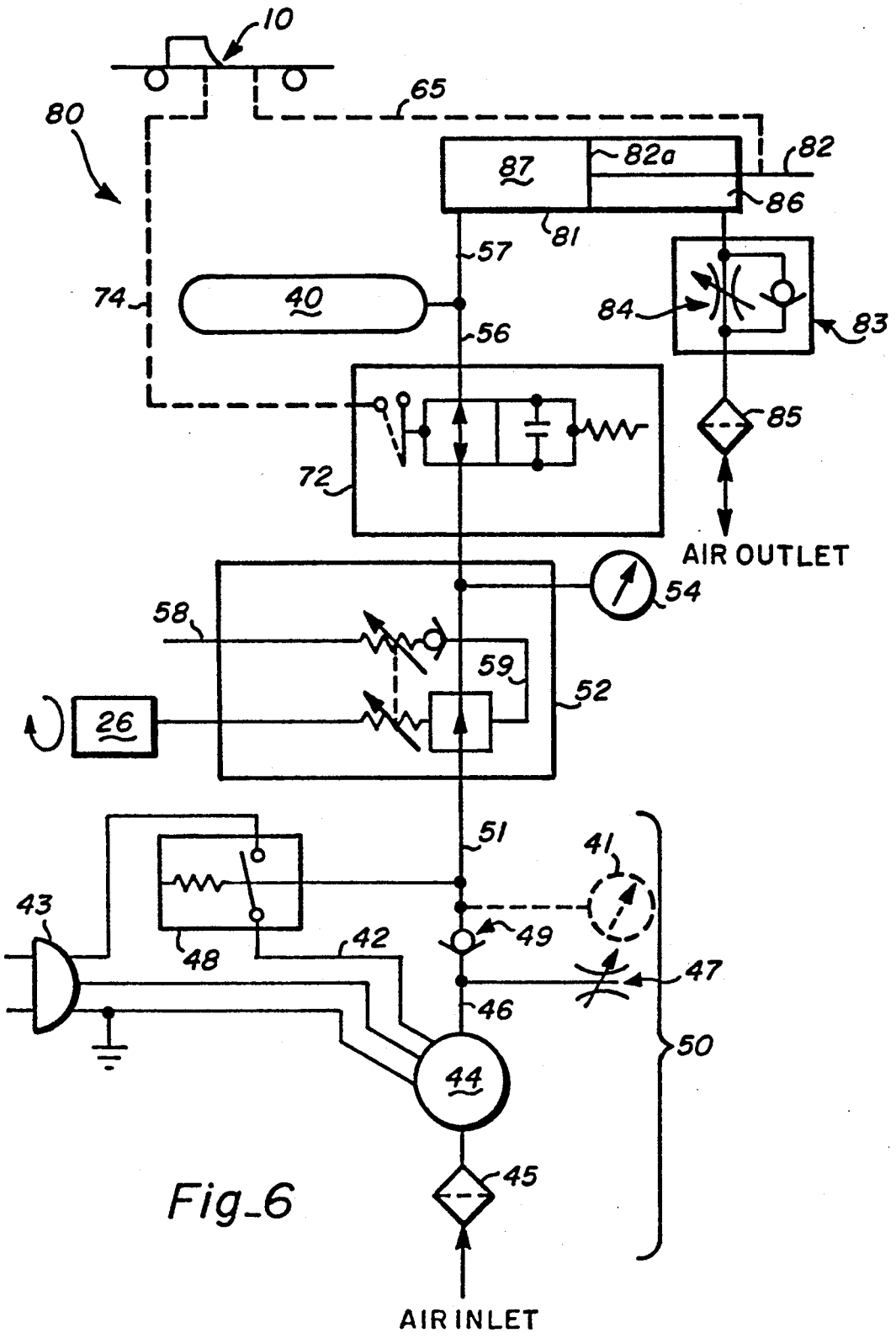

FIG. 4*a* is a front cross-sectional view taken along the lines and in the direction of arrows 4*a*—4*a* of FIG. 3 showing the detail of the sliding means associated with the carriage assembly;

FIG. 4*b* is an enlarged fragmentary view in partial cross-section taken along the line and in the direction of arrows 4*b*–4*b* of FIG. 4*a* showing the detail of the control valve/carriage cam mechanism;

FIG. 5 is a top plan view of the rehabilitation device of the invention with the carriage assembly removed to show the detail of the pneumatic apparatus within the frame assembly;

FIG. 6 is a diagrammatic layout drawing of the pneumatic system; and

Figure 7A:
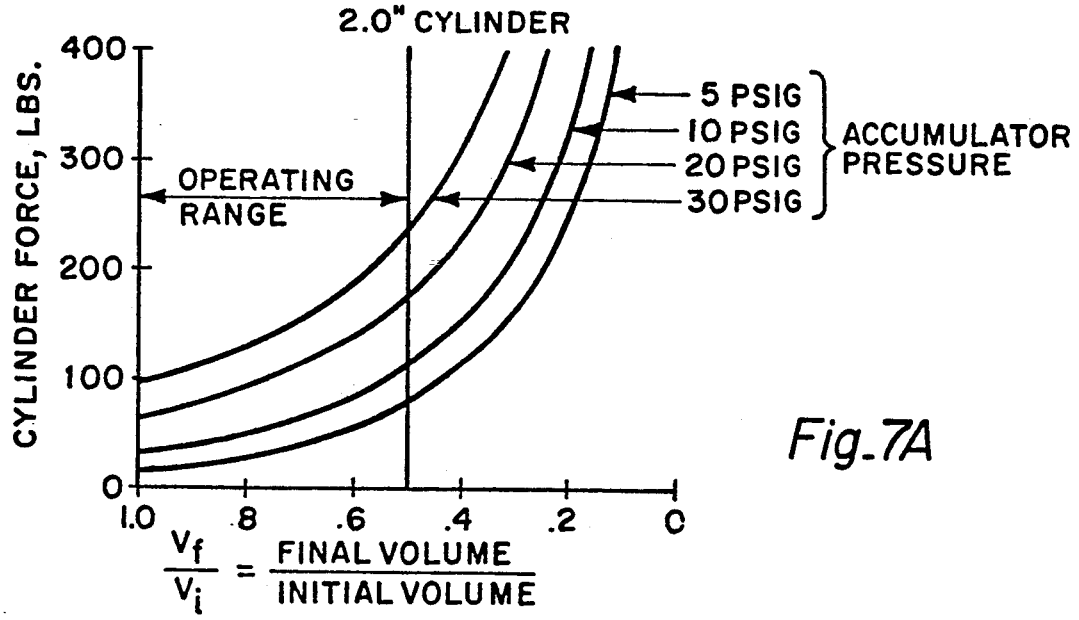
Figure 7B:
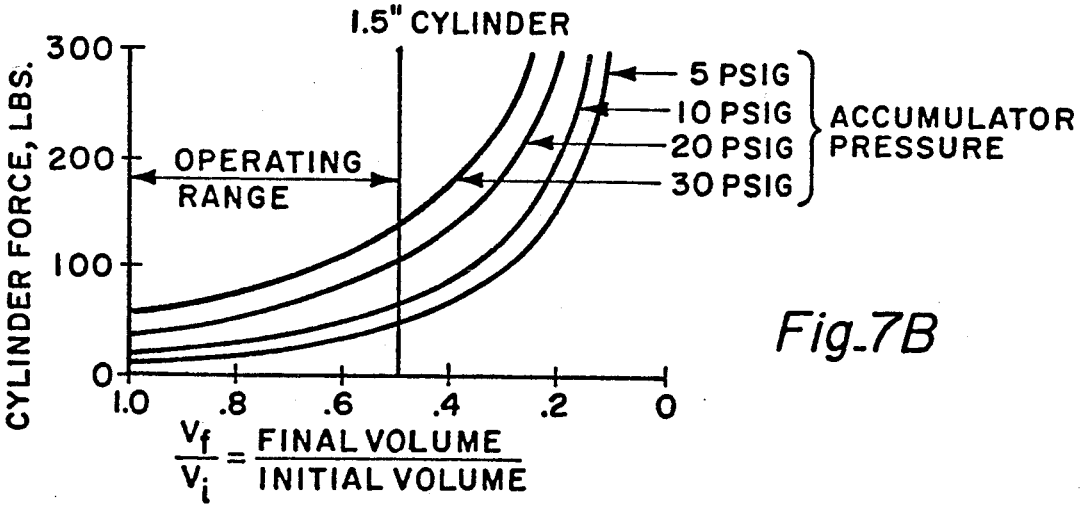

FIGS. 7*a* and 7*b* are graphs of accumulator pressure curves corresponding to the relationship of the cylinder force to volume ratio of combined volumes of the cylinder and accumulator.

SUMMARY

A pneumatic variable resistance rehabilitation/therapy apparatus is provided for the strengthening of musculature and ligaments associated with the major joints of the lower extremities of the human body. The rehabilitation/therapy apparatus employs the principals of closed kinetic chain rehabilitation wherein simultaneous co-contraction of opposing muscle groups is cause to occur during use of the apparatus so that ligaments associated with injured or post-operative joints are biomechanically protected through the replication of physiological principles of the human function. In other words, for the example of the injured knee joint, the surrounding muscles are strengthened without damage to the patellofemoral joint or patellar tendon.

The preferred embodiment of the invention is a pneumatically operated dynamic leg press which comprises a main frame structure which is adapted to receive a slidable carriage or bed thereon (a platform) and has attached at one end a foot support assembly having a padded foot rest against which a patient/user presses his or her feet to move the carriage against a resistive force. This is done while the user/patient is in a supine position.

The carriage assembly also includes a padded pillow and a padded bed or other contoured surface on which the user lies and a pair of opposed laterally extending handles for gripping by the user's hands during operation.

The foot rest assembly comprises a pair of laterally extending side rail members having appropriately positioned threaded rods terminating on their outer ends in hand knobs which function to secure the foot rest assembly to corresponding side members of the frame assembly. The foot rest assembly is adjustable laterally with respect to the frame assembly via the hand held knobs so that the appropriate amount of knee bend for the user may be provided while lying in the supine position with his or her feet contacting the upwardly extending foot rest pad of the foot rest assembly. A control box is also provided, preferably adjacent the foot rest pad, which contains a pressure control knob and pressure gauge to monitor and adjust system pressure to the desired level of resistance.

A display panel consisting of an assortment of digital readouts or gauges may be optionally provided adjacent the foot pad for displaying various information to the patient/user including work done, calories expended, number of repetitions, elapsed time and measurement of force applied to the foot rest pad. In addition, known formulas for calculating joint reaction forces may be used in combination with a microcomputer and the appropriate pressure detecting sensors to display a reading of the force exerted on the patellofemoral joint of the user.

The framework assembly contains the pneumatic system hardware and circuitry and also cooperates with the carriage assembly to permit the relatively low frictional sliding movement of the carriage assembly along the frame assembly.

The pneumatic system provides the resistive force against which the user must work while extending his or her legs from a bent position to a fully extended position. The pneumatic system comprises a cylinder having a movable piston and rod therein, and a pulley attached to the free end of the rod. A selected length of cable is attached at one end to the underside of the moveable carriage, is directed over and around the grooves on the pulley and is connected at its other end to a fixed point on the frame assembly. As the patient/user moves the carriage from a rest position (i.e., knees bent) to a working position (legs extended) the cable associated with the underside of the carriage is tensioned, thus resulting in the compression of the pulley and rod towards and into the cylinder. In other words, the linear translational motion of the carriage with respect to the frame assembly away from the foot rest corresponds to the compressive piston movement of the rod within the pneumatic cylinder. The cylinder is provided with a check valve at its rod end to ensure that a vacuum is not created during the compressive stages, which would otherwise prevent the effective piston rod movement and resistive force of the cylinder. An accumulator is also connected to the other end of the cylinder to provide an additional volume of air such that the resistive force of the cylinder does not become exponentially large during compression of the cylinder. The ratio of the volumes of the cylinder and accumulator are selected to simulate the resistance curve and rebound of a comparable mechanical compression spring system along the operating range of the pneumatic system.

The system is pressurized during a rest position. Actuation by the user of the pressure control knob activates a mechanical pump which directs air via a pressure regulator and cam-operated valve to pressurize the volumes of the accumulator and cylinder to the level desired by the user. During the working stroke (i.e., when translational movement of the carriage with respect to the frame assembly is caused to occur) the cam-actuated valve becomes closed thus preventing any further pressurization of the pneumatic system. Then, when returned to its rest position, any loss of system pressure (i.e., by air leaking past the seals in the cylinder) may be replenished via the pressure regulator which signals the air pump to repressurize the system up to the desired pressure level.

The pneumatic system specifically allows for a low resistance setting at an initial beginning or rest position and progressively increases to a greater resistive force at the fully extended or working condition. This progressive pneumatic resistance feature provides tolerable levels of resistance for the patient/user at the most critical stage of lower extremity joint rehabilitation (i.e., in the case of the knee joint where the knees are in a flexed or bent position) while achieving progressive and greater resistance at the end stroke where the joints are able to tolerate greater resistance. Indeed, progressive resistance at the fully extended position of the exercise stroke is necessary to ensure adequate strengthening of the musculature surrounding the injured joint.

The carriage-type configuration of the present invention has further advantages as it encourages co-contraction of agnostic and antagonistic muscle groups. This serves to replicate the physiologic function of concentric, eccentric, and closed kinematic chain exercises, such as running, jumping, climbing and squatting which are necessary to be replicated for rehabilitation purposes.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
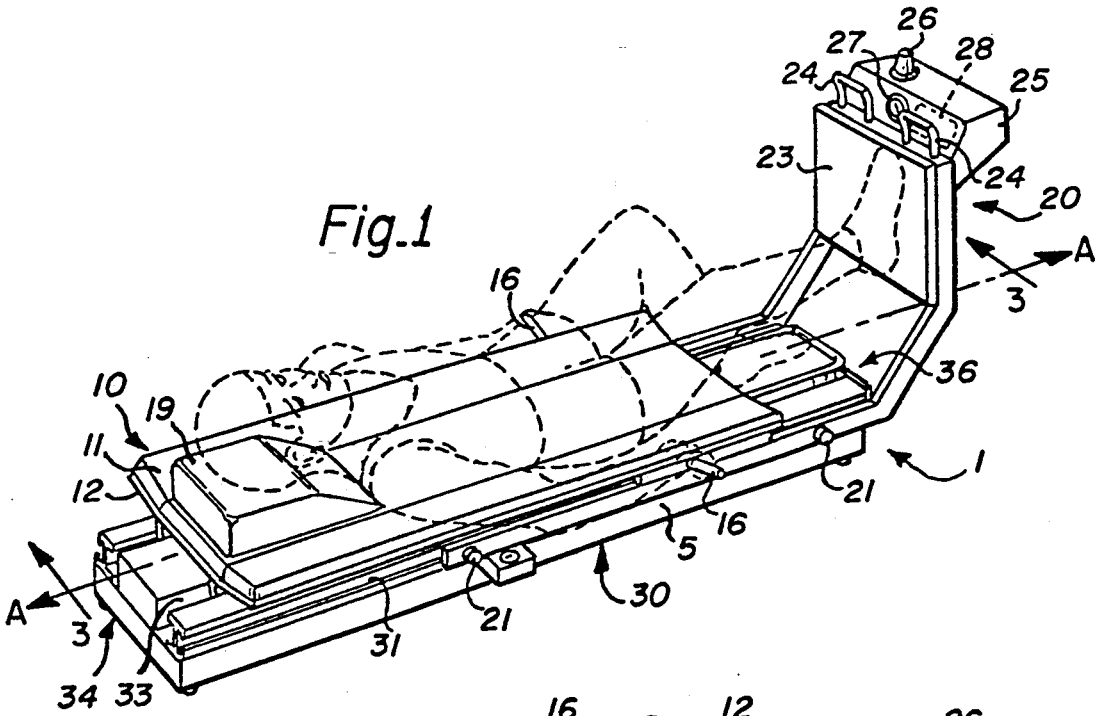
FIG. 1 is a perspective view of the rehabilitation apparatus of the present invention shown in a typical operative environment with a user positioned thereon (in phantom)

A rehabilitation apparatus constructed in accordance with one embodiment of the present invention is indicated generally by the reference numeral 1 in FIG. 1.

Figure 2:
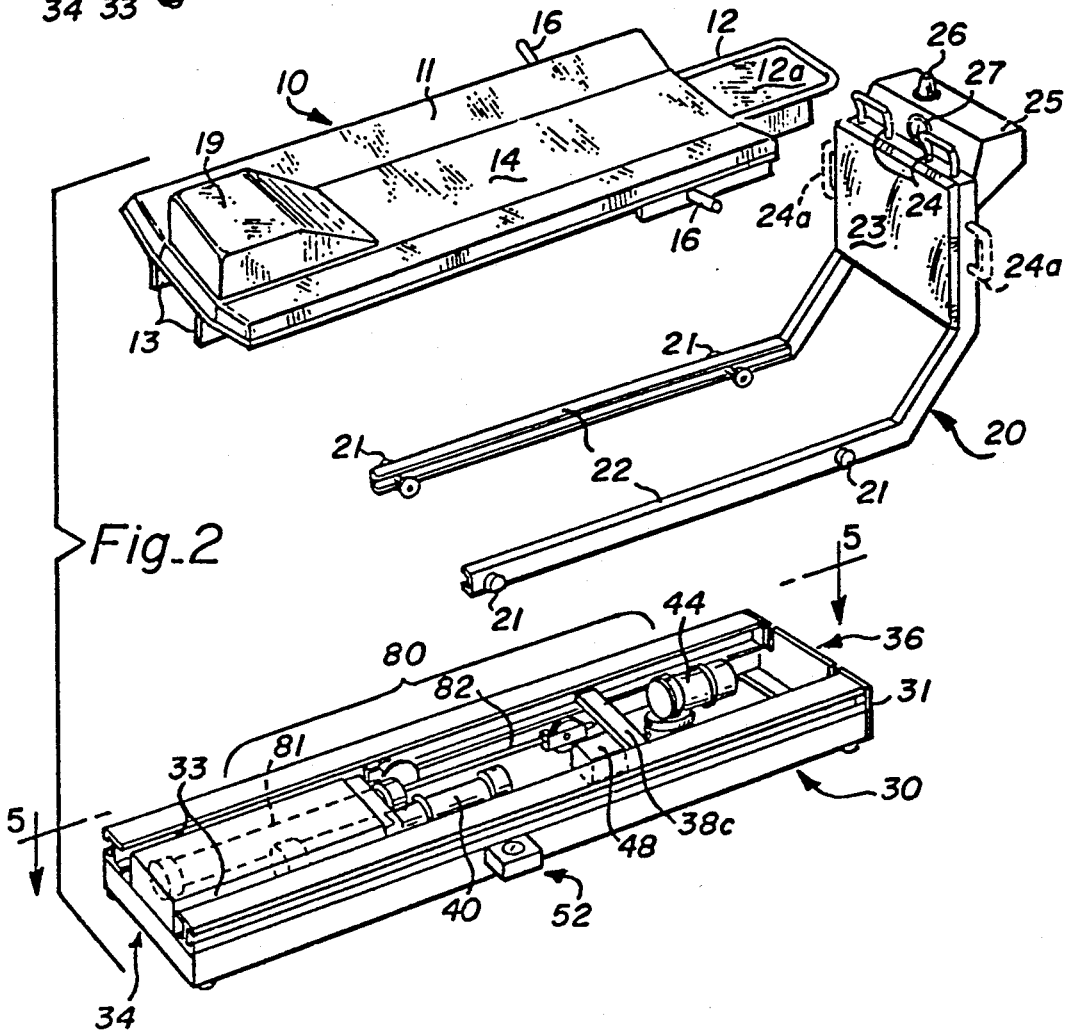
FIG. 2 is an exploded perspective view of the rehabilitation apparatus illustrating the movable carriage assembly, foot support assembly and frame assembly which comprise the three major elements of the rehabilitation apparatus.

As shown in FIGS. 1 and 2 the rehabilitation apparatus 1 is in the form of a leg press device and comprises three main parts including: 1) a carriage assembly 10; 2) a foot support assembly 20; and 3) a frame assembly 30. When fully assembled, side members 22 of the foot support assembly cooperate with the corresponding side members 31 of the frame assembly 30 to hold the two assemblies together in a fixed relationship. Hand held, screw-in knobs 21 are provided on side members 22 to assist in adjustably securing the position of side members 22 in a selected horizontal location along side members 31 of the frame assembly 30. The knobs 21 are adjustable by normal hand strength so that a user may horizontally extend (to the right in FIG. 1) or retract (to the left in FIG. 1) the foot support assembly 20 with respect to the frame assembly 30 to achieve the desired degree of knee bend before beginning use of the rehabilitation apparatus 1. The carriage assembly 10 further comprises a platform 11 and carriage frame 12. The carriage frame 12 has a pair of spaced vertical members 13 on which a sliding means (not shown) is mounted. The sliding means is discussed in greater detail with reference to FIG. 4*a*. When fully assembled the vertical members 13 of carriage frame 12 are disposed to reciprocate back and forth within the slots 33 of the frame assembly 30.

To use the rehabilitation apparatus of this invention, a user lies down on his/her back (i.e., in a supine position) on the platform cushioned surface 14 with his head supported by headrest 19 and hands gripping handles 16. The foot support assembly 20 is then adjusted (i.e., by lateral positioning) either backward or forward with respect to the frame assembly 30 such that the user's feet are supported by foot rest 23 and the user's knees are bent to the desired degree. During operation, the starting point for the carriage assembly is that as substantially shown in FIG. 1 (i.e, with the carriage 11 positioned so that the user's knees are bent). This position corresponds to an "at rest" position of the pneumatic system 80. Full details of the pneumatic system are disclosed below.

After the user has positioned him or herself on the rehabilitation apparatus 1 as in the above described manner and has made the necessary fore/aft adjustments of the foot support assembly 20, the pneumatic system 80 may be turned on and the desired resistive pressure setting may be selected by turning or rotating the pressure regulator knob 26.

Once the desired pressure setting has been selected, the user then presses his or her feet or foot against the foot rest 23 in order to extend his or her legs and to displace the carriage assembly 10 towards the head end 34 of the frame assembly 30.

Upon full extension of the carriage assembly 10, the resistive force that has built up in the pneumatic system 80 (as a result of the extension of the user's legs) will force the return of the carriage assembly 10 to its "at rest" position (i.e., where the user's knees are bent) as if the energy stored in the cylinder had been stored in a spring. Thus, the user is also required to use "negative resistance" (i.e., resist the return force of the pneumatic system 80) in a completed cycle of the rehabilitation apparatus 1 of this invention. The negative resistance required by the user due to the return speed of the compressed rod 82 within the cylinder 81 is carefully regulated by use of a pressure relief or restrictor valve. This is discussed in greater detail with reference to FIG. 6. A user may operate this apparatus to rehabilitate either leg separately or both legs simultaneously. For single leg operation, a flat surface area 12*a* is provided along the top of carriage frame 12 for placement of the other (non-used) leg. This is best seen in FIG. 1.

The foot support assembly is also provided with handles 24 which assist the user in getting him or herself up, off of, or lowering him or herself down onto the carriage bed 14 when using the rehabilitation apparatus 1 of this invention. Also provided, preferably as part of the foot support assembly, is a control box 25 in which the regulator knob 26 and pressure gauge 27 are contained. It should be understood that the controls may be placed in any convenient place, e.g. in the side 5 of frame 30 (FIG. 1), in an arm that extends up from frame 30 to within convenient hand reach and eyesight (not shown), or in a separate small control box attached to the unit via an umbilical (not shown).

The control box 25 may optionally contain a display panel 28 (shown in phantom in FIG. 1) comprising of a plurality of digital indictors or gauges which gives the patient/user a constant readout of useful information while using the rehabilitation device 1 of the invention. The information display panel may include but is not limited to an informational display of: the total work done; time of work; number of repetitions completed; and calories expended. In addition, known formulas for calculating joint reaction forces may be used in combination with the appropriate pressure detecting sensors and a microcomputer to display a reading of the force exerted on the patellofemoral joint (knee cap) of the user. This information is particularly useful to a therapist monitoring the rehabilitation exercises.

While in use, the user may also actuate the pressure regulator knob 26 to adjust the air pressure within the pneumatic circuitry to a different desired setting. However, as a point of caution, all adjustments should be made while the apparatus is in the "at rest" position so that undue force resulting from increased pressure demands is not placed on the pneumatic circuitry. Indeed, this situation is rendered moot in the case of single person operation as the controls are placed out of "hand grasping" distance in all but the "at rest" positions of the apparatus. Also, safeguards within the pneumatic circuit, namely the cam-actuated valve assembly 70 (see FIGS. 4*a* and 4*b*) are provided to ensure that the pneumatic system can not be inadvertently tampered-with during the work condition or stroke.

Depressing the regulator knob 26 followed by a clockwise rotation triggers pressurization of the pneumatic pressure system 80 which, in turn, provides a resistive force against the travel of the carriage platform 11 in the direction of the head end 34 of frame assembly 30. Pressure gauge 27 indicates this change in pressure and allows the user to monitor the positive pressurization of the pneumatic system 80 until a desired resistive force or pressure setting is reached. Then the user releases the downward force to the pressure regulator knob (this allows it to "click" or "pop" up to a lock position of the knob) to retain that pressure setting. In a similar manner the user may decrease the resistive force that the carriage 10 must work against in order to move within frame assembly 30 by merely depressing regulator knob 26 and rotating it counter clockwise. This bleeds the pneumatic system 80 of positive pressure and will quickly decrease the system pressure to zero PSIG unless the user releases the regulator knob to hold system pressure steady at a lower pressure setting.

While a primary object of the present invention is to provide an apparatus employing variable pneumatic resistance to rehabilitate injured or post-operative knee joints (i.e., by strengthening the surrounding musculative without injury to the patellofemoral joint or patellar tendon), the leg press embodiment of this invention also provides rehabilitative benefits to all the major joints of the lower extremity simultaneously, including, but not limited to the hip, ankle and foot musculature.

The horizontal sliding feature of the leg press permits the use of opposing muscle, groups simultaneously, and encourages co-contraction of agonistic and antagonistic muscle groups during the entire exercise stroke. Thus, while a user is lying on his/her back in a neutral position (particularly effective for back patients) using the leg press and causing the carriage to slide back and forth by alternatively extending and bending his/her leg(s), both the quadriceps (agnostic muscle group) and hamstrings (antagonistic muscle group) are being contracted simultaneously (i.e., a condition known in the rehabilitation field as "co-contraction"). This effect is highly recommended as it replicates the physiological functions of concentric, eccentric, closed kinetic chain exercises. In other words, it replicates the actions of running, jumping, climbing, squatting, etc, that the user experiences in his/her work or sport activities, but without at the same time stressing the back.

The supine or reclining feature of the carriage assembly also provides added benefits for users experiencing lower back pain or who are recovering from post operative surgery. Most low back pain or injured patients are instructed to pick-up objects or stoop by bending at the knees while maintaining an upright, neutral spine alignment. Many patients have difficulty performing this type of activity while supporting their entire body weight. Unlike other pneumatic, hydraulic and mechanical exercise machines that are directed to exercising the lower extremity muscle groups (e.g. a squat machine), the rehabilitation device of the present invention does not require the user to work against the gravitational force (and the associated changes in momentum) of his or her own weight. Thus, unnecessary additional weight (due to a user's upper body/torso) is never placed on the fragile knee joint of the user who is undergoing rehabilitative exercises through use of the invention. Exercise in this fashion is therefore "gravity neutral." In other words, the patient's mass, but not his/her weight is taken into consideration for the resistance associated with the rehabilitative exercise of this invention.

Moreover, by lying down horizontally, the user's back is supported and is maintained in a neutral position resulting in stress-free spinal alignment. The risk of injury or strain to the lower back musculature is minimized while the users's back is supported in such a fashion.

It should be understood that major injured or weakened joint areas in the upper extremity, including major injuries, may also be treated by use of the present invention. The user/patient may simply lie down on the bed surface 14 in a supine or prone position in a direction opposite that shown in FIG. 1, and contacts the foot rest 23 (now a hand rest) with his or her hands. The support assembly 20 is adjusted laterally with respect to the frame assembly 30 so as to maintain a desired degree of elbow bend in the "at rest" position. Additional hand holds 24*a*, shown in phantom in FIG. 2, can be provided to assist in use. Moreover, as is best seen in FIG. 3, optional vertical supports 6 and handles 7 (both shown in phantom) may be provided adjacent the head end 34 of the rehabilitation apparatus 1 of this invention. This permits the user to pull, rather than push, the carriage 11 towards the head end 34 of the frame assembly 30 in order to begin the working stroke of the exercise cycle. In this embodiment the user may remained positioned on the bed surface 14 just as he or she would when performing leg press exercises (i.e., the user may remain in the supine position).

Generally, lower resistance pressure levels will be used by the patient in the upper extremity configuration to compensate for the strength disparity between the upper and lower extremities. And, as will be seen in the comparison of FIGS. 7*a* and 7*b*, a smaller cylinder diameter is desirable for rehabilitation (or even strengthening exercise) of the upper extremities.

The major components of the pneumatic system 80 consist of a pneumatic cylinder 81, an accumulator 40, a pump 44, a pressure switch 48 and a pressure regulator 52.

As is best seen in FIGS. 2, 3, 5 and 6, positive pressurization of the pneumatic system is accomplished when the user actuates the regulator knob 26 in the positive pressure mode, pump 44 supplying positive air pressure to the air volumes of the cylinder 81 and accumulator 40 to the maximum of air pressure switch 48 as regulated by regulator 52. As previously mentioned, the volumes of the cylinder 81 and the accumulator 40 may only be pressurized when the carriage 11 is in the "at rest" position (this is best seen in FIG. 3). This is the only condition where cam actuated valve 72 is open. The extended position of carriage 11 (shown in phantom in FIG. 3) indicates a "work" condition, whereby the carriage 11 and carriage assembly 10 are being moved toward or away from the head end 34 of the frame assembly 30. This "work" condition corresponds to the reciprocating piston action of piston rod 82 within cylinder 81. The linear sliding motion of the carriage assembly 10 and carriage 11 with respect to the frame assembly 30 is translated into this piston action by means of an intermediate pulley assembly 60 and cable 65 which links the underside of the carriage 11 to the frame assembly 30. As is best seen in FIGS. 3 and 5, pulley 61 is mounted on the free end of piston rod 82 and is turned or rotated in response to the movement of cable 65 around it. One end of cable 65 is fixed to the underside of carriage frame 12 at attachment point 66 while the opposite end of cable 65 is secured to the frame assembly 30 at attachment point 67 (cross member **38*b* of FIG. 5). The cable attachment may be accomplished by any number of conventional means, including, but not limited to securement by a looping the cable end about a threaded nut and bolt combination. Note that by use of pulley 61 and the location of attachment points 66 and 67** the piston travel is co-linear with the carriage, i.e. in the same direction. This simplifies construction and pneumatic activity and is a direct action device.

The location of attachment points 66 and 67, in combination with the pre-selected length of cable 65 and the selected pulley diameter of pulley 61, are sufficient to permit a wide range of linear translational travel of carriage assembly 10 with respect to frame assembly 30, such that piston rod 82 does not bottom out within cylinder 81. However, the absolute range of the linear translational motion of carriage assembly 10 is confined by the contacting of opposed stop members 15, **15*a* (FIGS. 3 and 4*a*) associated with the underside of carriage 11 against coordinate side rubber bumpers 32 disposed along the upper top surface portion of a side member 31 of the frame assembly 30. This is best seen in FIGS. 3, 4*a* and 5**.

An important feature of the pulley system is that the use of the pulley and cable provides an indirect stroke to the over all exercise cycle of the rehabilitation apparatus 1. This indirect stroke provides a longer working stroke to the overall apparatus than it would otherwise have if the reciprocating movement of the carriage 11 was directly linked to the piston rod 82. In other words, a direct linkage would result in accumulator pressure curves that rapidly approach an infinite amount of resistance (cylinder force) as the volume ratio $V_f/V_i$ is decreased (see FIGS. **7*a* and 7*b*). For a more detailed discussion on the influence of varying volume ratios on accumulator pressure curves see the below description which references FIGS. 7*a* and 7*b***.

FIG. **4*a*, shows a cross-section view of the pneumatic system of the rehabilitation apparatus 1 along line 4A—4A of FIG. 3. The carriage assembly 10 is permitted to move or slide with respect to frame assembly 30 by means of wheels 17 mounted on the vertical members 13 of the carriage frame 12. The wheels 17 are disposed to roll along a surface of side members 31 of frame assembly 30 and are guided within channel 32 of frame assembly 30. FIG. 4*a* also shows the detail of how the wheels 17 are attached to the vertical members 13 by means of nut and bolt assembly 18. In addition, the detail of the attachment between knobs 21, foot support side members 22 and frame side member 31 by means of threaded pin and locking plate assembly 38 are illustrated. While the preferred embodiment of this invention discloses the sliding means between the carriage assembly 10 and the frame assembly 30** as in the form of two or more pairs of wheels having roller bearings, it is understood that other forms of sliding means may also be utilized for use in performing the linear transnational movement of this invention, including, but not limited to ball bearings, straight roller bearings, spherical roller bearings, slide blocks, etc.

As is best seen in FIGS. **4*a* and 5 a plurality of cross-members 38*a*, 38*b* and 38*c* of frame assembly 30 provide the supporting structure for mounting the various and several components of the pneumatic system 80 within the space 35 (i.e., space 35 is defined as the hollow enclosure formed by the union of the carriage assembly 10 and the frame assembly 30). Pneumatic cylinder 81 is supported by cross member 38*a* at its bottom distal end and by cross member 38*b* at its top or rod end. Cross member 38*b* is also used as a mounting structure for supporting the accumulator 40 (approximately at its midpoint) and for mounting the cam actuated valve assembly 70. Finally, cross member 38*c* provides a mounting structure for the pump 44 and pressure switch 48**.

The cam-actuated valve assembly 70 includes a valve support 71 which is used for mounting a cam actuated valve (or "cam-operated valve") 72 on the cross member **38*b*. The cam operated valve 72 is held in the open position (i.e., for full flow therethrough) when the roller member 73 is disposed to fully "ramp up" on the flat portion of the cam 74 which is associated with the underside of carriage frame 12. Roller member 73 is normally spring biased in a direction against the underside of carriage frame 12 and pivots about point 75 resulting in a range of motion for the roller member indicated by arrow C. As is best seen in FIG. 4*b*, movement of the carriage frame 12 in the direction of arrow B results in the closing position (the biased upward position of roller member 72) of the cam operated valve 72. This would correspond to a movement from the initial "at rest" position of the rehabilitation apparatus 1 (i.e., the position of carriage 11 in FIG. 3) to a "work" position (that is, work is required to move the carriage 11 to overcome the resistance pressure of pneumatic cylinder 81). A fully extended work position corresponds to the carriage frame 11 shown in phantom in FIG. 3**.

OPERATION OF THE PNEUMATIC SYSTEM

Referring now to FIG. 6, the major elements of the pneumatic circuit generally comprise the above-mentioned cylinder 81 mechanically linked to the carriage assembly 10 via cable 65, accumulator 40, cam-operated valve 72 contacting cam 74, manually adjustable (knob 26) self-relieving (via vent line 58) pressure regulator 52, including a pilot line 59 and a pressure gauge 54 associated therewith, and an air pressure supply assembly 50. The air pressure supply 50 includes the pump 44 and a pressure switch 48. In the preferred embodiment, pressure switch 48 is preset for 65 PSIG. It is understood that the air pressure supply may include a direct line to a constant air pressure source, such as a connection to a plant facilities' air compressor. For purposes of portability, the air pressure supply of this invention is self contained for convenient and quick set up at any location.

The operation of pneumatic circuit 80 is described with reference to four distinct conditions.

CONDITION 1

This is the initial condition wherein the rehabilitation apparatus is in the "at rest" or "rest" position. This also corresponds to the position of the carriage 11 which provides for maximum knee bend and where the cylinder rod 82 is fully, outwardly extended. Also during this position, the cam actuated valve 72 is held open by the cam 74 on the carriage 12 (see FIGS. 4*a* and 4*b*). The system pressure is set by using the pressure regulator knob 26 as is described above in reference to FIG. 3. During pressurization of the system, the regulator knob sends a signal to the pressure switch 48 which, in turn, signals pump 44 to begin positive airflow via circuit path 42. The pump 44 draws ambient air in through inlet (filter/muffler) 45 (see also FIG. 5) and directs the air through outlet tube 46 where it passes through first, the pressure regulator 52, and then through the opened cam actuated valve 72 in order to build up air pressure within the cylinder 81 and accumulator 40 via tubes (airlines) 56 and 57, respectively.

The system becomes fully pressurized after only a few seconds. The pressure gauge 54 indicates when the cylinder 81 and accumulator 40 have reached the levels initially set by the pressure regulator 52. The pressure setting of the pressure regulator 52 can be increased or reduced by adjusting the regulator knob 26 and can also be monitored by the user by reading the pressure gauge 54 (see FIGS. 5 and 6). Excess pressure is bled off via vent line 58, and pilot line 59 counter-balances the vent line spring.

The pressure regulator 52 is also provided with a self relieving pressure means (vent line 58 not shown) which permits air from pump 44 to pass through it until a desired reduced pressure setting is reached. This pressure is generally less than the pressure deliverable via pressure switch 48. To increase the regulated pressure, the regulator knob 26 is turned in the other direction, thus allowing air from the air supply 50 to bleed into the accumulator 40 and cylinder 81 until the desired increase in the regulated air pressure is attained. The pressure gauge 54 displays regulated pressure. An optional pressure gauge 41 (shown in phantom) may be provided down line from the check valve 49 associated with pump outlet tube 46 to give an actual reading of pump outlet pressure.

It is important to note that all pressure regulator adjustments should be done while the carriage 11 is in the rest position, since this is the only time that the cam actuated valve 72 is open. Otherwise, damage may occur to the piston seals in the cylinder 81, or undue stress may be placed on the pneumatic circuitry as a whole which would result in premature failure, or the sudden increase in pressure could injure the patient user.

CONDITION 2

In the second condition the carriage 11 is moving away from the rest position and towards the head end 34 of the rehabilitation apparatus 1 (see the carriage 11 shown in phantom FIG. 3). The carriage 11 encounters an increasing resistance while moving in this direction due to the air pressure that is caused to build up as the piston rod 82 compresses the air within cylinder 81. When the carriage leaves the rest position of condition 1, the cam actuated valve 72 is closed and thus prevents air flow through it (see FIG. 4*b*). The rehabilitation work is thus being done only against air in cylinder 81 and accumulator 40.

During the work stroke of the piston, the check valve 83 automatically opens so that air is permitted to enter the rod end 82 of cylinder 81 so that a vacuum does not build up on the plunger side of the piston head within cylinder 81 during compression to inhibit rod movement.

CONDITION 3

In the third condition, the carriage 11 has already reached the end of its sliding motion towards the head end 34 of the frame assembly 30 (fully extended position of user's legs or arms) and is resuming motion back towards the rest position. In other words, the piston rod 82 is now on the return stroke from its fully compressed position within cylinder 81. As discussed above, the movement of rod 82 and piston 82*a* within cylinder 81 varies with the linear sliding movement of carriage 11 with respect to the frame assembly 30 by means of the interconnecting cable 65 and pulley assembly 60. The air pressure building up within the cylinder 81 and accumulator 40 forces the piston/rod 82, 82*a* within cylinder 81 back towards the rest position. An adjustable needle valve restrictor 84 assembly is placed at the rod end of cylinder 81 to prevent both excessive return speed and "shock stop" (when stop member 15 of the carriage 11 comes into rapid contact with rubber bumpers 32) upon return of the carriage 11 to the rest position. By slowing the exhausting of air from space 86 on the rod side of the piston to the atmosphere by the needle valve restrictor 84, complete control of the return stroke is achieved. Uncontrolled and potentially dangerous bungee cord, spring or gravity return is avoided. The patient can use the stored energy of the compression or work stroke to return the carriage in a controlled manner that depends on the rehabilitation needs. Where the knee is severely injured, the return can be a gentle "float back" that prevents abrupt shock to the tissues and ligaments.

CONDITION 4

Once the system is pressurized, a small amount of air can be expected to seep around the moving seals of the piston head within the cylinder 81. As this condition occurs, additional air is supplied to the pneumatic system through the regulator 52 to the cylinder 81 and accumulator 40 to balance the pneumatic system pressure. The regulator 52 senses any pressure loss and signals the air supply 50 via pump 44 to increase system pressure. This additional air is only permitted to flow while the carriage 11 is in the rest position and while the cam actuated valve 72 is open.

The accumulator 40 is provided to supply an additional volume of air for the cylinder 21 so that the cylinder force rate associated with the pressure on the cylinder head 86*a* over a wide range of piston rod accelerations will approximate a spring force constant of a mechanical system. The accumulator prevents the build up of excessively high pressure that would normally be obtained in the cylinder alone as the piston motion reduces the air volume to zero.

Based on the relationship:

$$P_iV_i=P_fV_f$$

the final pressure ($P_f$) approaches infinity as the final volume ($V_f$) approaches zero. Thus, by using the accumulator, the final volume (being the combined volumes of both the accumulator and cylinder) of the pneumatic system will never be less than that of the volume of the accumulator. This translates into more reasonable pressure demands (i.e., force resistance demands that are required by the user).

If, for instance an accumulator is not provided, the resistive force of the cylinder would become exponentially large as the user begins to extend his or her legs and slide the carriage back after only a short sliding distance of the carriage. Such a dramatic increase in resistance can be very damaging to an already injured knee, and thus the ratio of initial to final volumes is critical. By selecting the properly sized accumulator such that the initial volume ($V_i$) is approximately twice that of the final volume ($V_f$) a close approximation to a mechanical spring rate is achieved. This is desirable, as a smooth and progressive rate of resistance is beneficial for rehabilitation purposes. This is true for any rate of acceleration which the user may need choose to displace the sled assembly in order to achieve the appropriate "rep rate" (repetitions per minute) for rehabilitation. Hydraulic systems do not permit easy rep rate change. In the preferred embodiment, the volume of the accumulator is approximately equal to the volume of the cylinder.

Referring now to FIGS. 7*a* and 7*b*, the critical operating range for various accumulator pressure levels are shown. Both figures show a graph of the cylinder force versus the ratio of the final to initial system volume. The volume ratio includes the combined volumes of both the cylinder and accumulator. Since cylinder force is a function both pressure and cylinder head area, we have:

F=PA, where F is the cylinder force;

P is the pressure acting on the cylinder head;

and A is the area of the cylinder head,

And since pressure varies in response to a change in volume according to the relation $P_oV_i=P_fV_f$, for a decrease in cylinder volume the pressure acting on a cylinder head increases. This is reflected in the graphs of FIGS. 7*a* and 7*b* wherein the combined cylinder plus volume ration, $V_f/V_f$, decreases during compression which corresponds to an increase in the cylinder force. The operating range is defined as the range of the volume ratio such that the accumulator pressure curve is substantially a linearly increasing curve having a positive slope of about 2 (i.e., where it approximates a progressive spring force rate).

Thus, the addition of the accumulator volume to the overall system volume ensures that the final volume will never be less than the volume of the accumulator. Volume ratios, $V_f/V_f$, in the range of 1:2 to 1:3 replicate a resistance curve equal to that of a mechanical spring system. Thus, the initial resistance, being small, is tolerable by a patient using the leg press embodiment of this invention and is steadily increased to a more strenuous level of resistance (at final volume $V_f$) where greater stresses are tolerable to an extended knee joint and needed for rehabilitation. But unlike a mechanical spring system, the pneumatic resistance of this invention has means for controlling the return force on the return (negative) stroke by slowing air release from the rod side 86 of cylinder 81 (FIG. 6). This ensures that a desired level of decreased pneumatic resistance is experienced by the user to prevent undue stress on the knee joint of the user as the knees are returned to a bent position. The user does not need to use the injured knee joint as a return shock absorber. In use, a user will generally start at a low system pressure until that resistance curve no longer proves beneficial. At this time the user may increase the initial accumulator/cylinder system pressure to operate against a greater progressive resistance curve. As is best seen in a comparison of FIGS. 7*a* and 7*b*, a shallower (flatter and more nearly linear) resistance curve may be achieved by decreasing the cylinder head diameter (hence effectively decreasing the cylinder volume) and retaining the same accumulator volume. As $V_f$ in the 1.5" cylinder is greater than $V_f$ for the 2" for the same stroke length, this results in a lower overall progressive resistance curve for all levels of system pressure as compared to the larger diameter cylinder of FIG. 7*a*.

The features of variable system pressure combined with using differently sized cylinder head diameters provides a wide range of resistance levels available to a patient/user in order to design an intelligent and safe rehabilitation exercise/strengthening program.

It should be understood that various modifications within the scope of this invention can be made by one of ordinary skill in the aforementioned art without departing from the spirit thereof. For example, the adaptation of the leg press embodiment for use in strengthening and rehabilitating major joints associated with the upper extremities. Further examples are: mounting the pressure controls 26 and/or gauge 54 in a hand-held box via an umbilical through which tubes 69 pass; reversing the direction (position) of the action of the pressure cylinder particularly useful for upper extremity rehabilitation; and use of any body contour support means and adapting it for prone positive use as needed. We therefore wish our invention to be defined by the scope of the appended claims in view of the specification as broadly as the prior art will permit.

We claim:

1. A pneumatic physical therapy and rehabilitation device for balanced strengthening of muscle groups of an operator/patient in controlled manner, which muscle groups are related to injured, weak, or post-operative joints including associated ligaments and tissue, said device comprising in operative combination:

a) an elongated frame having a longitudinal axis, a top, and a bottom, said bottom including means for resting said frame on the floor;

i) said frame having a first foot end, and a second head end spaced therefrom along said longitudinal axis;

b) a carriage assembly having a patient supporting bed surface, a first foot end, and a second head end;

i) said carriage assembly is disposed reciprocatingly supported by said frame;

c) means for low friction reciprocating movement of said carriage with respect to said frame, said movement being generally parallel to the longitudinal axis of said frame from a first rest position adjacent said first foot end of said frame to a second extended position adjacent said second head end of said frame;

i) the composition of one reciprocating movement of said carriage being defined as an exercise cycle;

ii) said exercise cycle having a first working stroke in a first direction and a second return stroke in the opposite direction;

d) a rest assembly disposed spaced from said second head end of said frame;

i) said rest assembly having a rest member for contact by an extremity of an operator/patient positioned on said carriage;

e) means for adjustably securing said rest assembly to said frame in a selected fixed position during use;

f) pneumatic means for applying progressive resistance against the reciprocating motion of said carriage with respect to said frame member during said working stroke such that when an operator/patient initially exerts force with respect to said rest member causing said carriage to move in said working stroke, said progressive resistance smoothly and continuously increases to a maximum resistance;

g) means for control of the movement of said carriage during said return stroke to permit said progressive resistance to smoothly and continuously decrease back to its original level and to provide substantial reduction in shock stop upon operator/patient release of pressure on said rest member;

h) said pneumatic resistance means including an initial volume, $V_f$, greater than a final volume, $V_f$, and the volume ratio $V_f/V_f$ being greater than about 0.5;

i) means for preselecting the level of said progressive resistance in any desired incremental amount between essentially zero resistance up to a rehabilitative physiological challenge level; and j) said pneumatic resistance means operates independently from said return stoke control means, said pneumatically resistance means in combination with said return stroke control means closely replicate the physiological function of the affected muscle groups for active rehabilitation of at least one extremity.

2. A pneumatic physical therapy and rehabilitation device as in claim 1 wherein said means for applying a progressive pneumatic resistance and said means for return stroke control includes a pneumatic circuit comprising in operative combination:

a) a cylinder containing a reciprocating piston and rod assembly, said cylinder comprising a confined volume defined between a side wall, a first rod end and a second closed end;

i) said reciprocating piston having a rod side and a cylinder side, a first rest condition, and a second operating condition;

ii) said piston operating condition including an operating range corresponding to said reciprocating movement of said exercise cycle of said carriage such that air within said cylinder confined volume is compressed by said reciprocating piston during said working stroke and is permitted to expand during said return stroke;

iii) said piston separating said confined volume into an evacuation zone in said rod side and a compression zone in said cylinder side, b) an accumulator having a confined volume which is in communication with said compression zone of said cylinder during both of said rest and operating conditions of said piston;

i) said confined volume of said accumulator is sufficiently large to provide a cylinder force resistance curve for said pneumatic circuit that approximates a spring force resistance curve of a mechanical spring system during compression of air in said compression zone of said cylinder by said piston during said working condition;

c) said cylinder includes a relief valve assembly disposed in communication with said evacuation zone of said cylinder;

i) said relief valve assembly includes an air inlet bleed valve adapted to permit entry of air into said evacuation zone to prevent substantial vacuum resistance from forming with said evacuation zone of said cylinder during said return stroke;

ii) said relief valve assembly includes means for controlling the exhausting of air from said evacuation zone during said return stroke;

d) a normally open valve disposed upstream of both said accumulator and said cylinder;

i) said normally open valve including means for self closure when said piston changes from said rest condition to said operating condition;

e) a pressure regulator disposed upstream of said normally open valve, said pressure regulator regulating the air pressure contained within both said confined volumes of said accumulator and said cylinder;

f) means for supplying pressurized air to said pneumatic circuit, said air supply means disposed upstream of said pressure regulator;

g) means for transferring said reciprocating movement of said carriage to said reciprocating movement of said piston; and h) means for adjusting pneumatic circuit air pressure, said circuit air pressure adjusting means is disposed in association with said pressure regulator to permit the communication of pressurized air via said circuit from said air supply means to said confined volumes of said accumulator and said cylinder when said piston is in said rest condition and said normally open valve is open, so that the cylinder force resistance curve associated with said reciprocating piston during said operating condition may be controlled in an infinitely variable manner.

3. A pneumatic physical therapy and rehabilitation device as in claim 2 wherein:

a) said means for transferring reciprocating movement is a pulley and cable system comprising;

i) a pulley disposed on said piston rod outside of said cylinder;

ii) a cable having a first end attached to said frame and a second end attached to said carriage; and b) said pulley system having a cable length and pulley diameter sized to provide progressive resistance by said pneumatic resistance means during said working stroke for rehabilitative purposes.

4. A pneumatic physical therapy and rehabilitation device as in claim 3 wherein said air supply means comprises:

a) an air pump;
b) a pressure switch associated with said pump to signal said air pump to provide air to said pneumatic circuit via said pressure regulator when said circuit air pressure drops below a minimum preset level; and
c) both said pump and said pressure switch being mounted to said frame to permit easy portability of said rehabilitation device.

5. A pneumatic physical therapy and rehabilitation device as in claim 4 wherein said rehabilitative device is a leg press machine designed for the rehabilitation of the anterior cruciate ligament of the knee to minimize patellofemoral problems associated with resistance loads placed on the knee in flexion, and wherein:
a) said rest member of said rest assembly is a foot pad spaced sufficiently from said head end of said frame to permit a desired degree of knee bend to the user/patient when the user/patient is positioned on said bed surface with at least one foot contacting said foot pad at said rest position, and to permit a desired amount of leg extension during said working stroke;
b) said bed surface includes a head rest disposed adjacent said head end adapted to support the user/patient's head during use of said leg press machine; and
c) said carriage includes at least a pair of opposed laterally extending handles, said handles being adapted to permit the user to stabilize body position on said bed surface.

6. A pneumatic physical therapy and rehabilitation device as in claim 5 wherein:
a) said means for preselecting the level of said progressive resistance is a control unit comprising:
i) a rotatable pressure knob; and
ii) a pressure gauge associated with said pressure knob and adapted to indicate the change in the level of said circuit air pressure in response to a rotational adjustment of said pressure knob.

7. A pneumatic physical therapy and rehabilitation device as in claim 6 wherein said control unit is contained in a housing, said housing having means for attachment to said rest assembly adjacent said foot pad.

8. A pneumatic physical therapy and rehabilitation device as in claim 6 wherein said control unit is contained within a housing and connected to said pneumatic circuit by an umbilical connection for convenient multi-positional use by a user/patient.

9. A pneumatic physical therapy and rehabilitation device as in claim 4 wherein said rehabilitative device is an upper extremity strengthening machine wherein;
a) said rest member of said rest assembly includes means for contact by at least one hand of a user;
b) said hand contact means is spaced sufficiently from said head end of said frame to permit a desired degree of elbow bend for at least one of the user/patient's arms when the user/patient is positioned on said bed surface at said rest position and to permit a desired amount of arm extension during said working stroke; and
c) said bed surface includes a head rest.

10. A pneumatic physical therapy and rehabilitation device as in claim 9 wherein:
a) said means for preselecting the level of said progressive resistance is a control unit comprising:
i) a rotatable pressure knob; and
ii) a pressure gauge associated with said pressure knob and adapted to indicate the change in the level of said circuit air pressure in response to a rotational adjustment of said pressure knob.

11. A pneumatic physical therapy and rehabilitation device as in claim 10 wherein said control unit is contained in a housing, said housing having means for attachment to said rest assembly adjacent said hand contact.

12. A pneumatic physical therapy and rehabilitation device as in claim 10 wherein said control unit is contained within a housing and connected to said pneumatic circuit by an umbilical connection for convenient multi-positional use by a user/patient.

13. A pneumatic physical therapy and rehabilitation device as in claim 4 wherein said rehabilitative device is an upper extremity strengthening machine wherein;
a) said frame is provided with a pair of handles, said handles being adapted to permit the user move said carriage toward said head end by a pulling motion;
b) said handles being spaced sufficiently from said foot end of said frame such that at least one of the user/patient's arms is substantially extended when the user/patient is positioned on said bed surface at said rest position and the user/patient achieves a desired degree of elbow bend during said working stroke; and
c) said bed surface includes a head rest.

14. A pneumatic physical therapy and rehabilitation device as in claim 13 wherein:
a) said means for preselecting the level of said progressive resistance is a control unit comprising:
i) a rotatable pressure knob for controlling said pressure regulator; and
ii) a pressure gauge associated with said pressure knob and adapted to indicate the change in the level of said circuit air pressure in response to a rotational adjustment of said pressure knob;
iii) means for processing exercise information received from a plurality of sensors provided to said rehabilitation device, said exercise information corresponding to work done, repetitions completed, time of use, calories expended and force exerted; and
iv) means for displaying said exercise information to a user.

15. A pneumatic physical therapy and rehabilitation device as in claim 14 wherein said control unit is contained in a housing, said housing having means for attachment adjacent said handles.

16. A pneumatic physical therapy and rehabilitation device as in claim 14 wherein said control unit is contained within a housing and connected to said pneumatic circuit by an umbilical connection for convenient multi-positional use by a user/patient.

17. A pneumatic circuit for rehabilitation machines to provide a variable progressive resistance for balanced strengthening of muscle groups of a user/patient, which muscle groups are related to injured, weak, or post-operative joints, including associated ligaments and tissue, said pneumatic circuit comprising in operative combination:
a) means for supplying pressurized air to said pneumatic circuit;
b) a cylinder disposed downstream of said pressurized air supply means and containing a reciprocating piston and rod assembly, said cylinder comprising a confined volume defined between a side wall, a first rod end and a second closed end;

i) said reciprocating piston having a rod side and a cylinder side, a first rest condition, and a second operating condition;

ii) said piston separating said confined volume into an evacuation zone on said rod side and a compression zone on said cylinder side, said compression zone in fluid communication with said pressurized air supply means;

iii) said piston operating condition including a first working stroke and a second return stroke, said working stroke being defined as the movement of said piston in a direction originating from said rod end towards said closed end and said return stroke being defined as the movement of said piston in a direction originating from said closed end towards said rod end;

c) an accumulator having a confined volume which is in communication with said compression zone of said cylinder during both of said rest and operating conditions of said piston;

i) said confined volume of said accumulator is sufficiently large to provide a cylinder force resistance curve for said pneumatic circuit that approximates a spring force resistance curve of a mechanical spring system during compression of air in said compression zone of said cylinder by the movement of said piston during said working stroke;

d) said cylinder includes a relief valve assembly disposed in communication with said evacuation zone of said cylinder;

i) said relief valve assembly includes an air inlet bleed valve adapted to permit entry of air into said evacuation zone to prevent substantial vacuum resistance from forming within said evacuation zone of said cylinder during said working stroke;

ii) said relief valve assembly includes means for controlling the exhausting of air from said evacuation zone during said return stroke;

e) a normally open valve disposed downstream of said pressurized air supply means and upstream of both said accumulator and cylinder;

i) said normally open valve including means for self closure when said piston changes from said rest condition to said operating condition;

f) a pressure regulator disposed downstream of said pressurized air supply means and upstream of said normally open valve, said pressure regulator regulating the air pressure contained within both of said confined volumes of said accumulator and said cylinder;

g) means for adjusting pneumatic circuit air pressure, said circuit air pressure adjusting means is disposed in association with said pressure regulator to permit the communication of pressurized air via said circuit from said air supply means to said confined volumes of said accumulator and said cylinder when said piston is in said rest condition and said normally open valve is open, so that the cylinder force resistance curve associated with said reciprocating piston during said operating condition may be controlled in an infinity variable manner, said pneumatic circuit air pressure adjusting means operates independently of said means of said relief valve assembly for controlling the exhausting of air from said evacuation zone of said cylinder; and h) said cylinder and said accumulator together providing progressive resistance to a member actuated by a user/patient and said means for controlling the exhausting of air from said evacuation zone during said return stroke permits said resistance to smoothly and continuously decrease back to its original level and to provide substantial reduction in stop shock upon user/patient release of force on said member in said return stroke, said progressive resistance and said controlled return without stop shock together providing an exercise cycle which closely replicates the physiological function of the affected muscle groups.

18. A pneumatic circuit as in claim 17 wherein the ratio of said confined volume of said accumulator to said confined volume of said cylinder is in the range of about 1:1 to about 3:1.

19. A pneumatic circuit as in claim 18 wherein said air supply means comprises:

a) an air pump;

b) a pressure switch associated with said pump to signal said air pump to provide air to said pneumatic circuit via said pressure regulator when said circuit air pressure drops below a minimum preset level; and c) both said pump and said pressure switch being mounted to a frame member of a rehabilitative device to permit easy portability of said rehabilitative device.

20. A pneumatic circuit as in claim 19 which includes means for preselecting the level of said progressive resistance in any desired incremental amount between essentially zero resistance up to a rehabilitative physiological level.

21. A pneumatic circuit device as in claim 20 wherein:

a) said means for preselecting the level of said progressive resistance is a control unit comprising:

i) a rotatable pressure knob for controlling said pressure regulator; and ii) a pressure gauge associated with said pressure knob and adapted to indicate the change in the level of said circuit air pressure in response to a rotational adjustment of said pressure knob;

iii) means for processing exercise information received from a plurality of sensors provided to said rehabilitation device, said exercise information corresponding to work done, repetitions completed, time of use, calories expended and force exerted; and iv) means for displaying said exercise information to a user during use.

22. A physical therapy and rehabilitation device for balanced strengthening of muscle groups associated with an extremity of an operator/patient in a controlled manner, which muscle groups are related to injured, weak, or post-operative joints including associated ligaments and tissue, said device including a member against which said operator applies force in a work stroke, which member has a return stroke, the improvement which comprises in operative combination:

a) means for progressively increasing resistance to movement by said member over the work stroke of said physical therapy and rehabilitation device;

b) means for controlled, progressively decreasing resistance to movement by said member over the return stroke of said physical therapy and rehabilitation device to provide minimum resistance at a point of maximum flexure of a user's extremity;

c) means for selectively setting an initial resistance level of said means for progressively increasing resistance; and d) said resistance setting means operates independently of said means for controlled progressively decreasing resistance of said member return stroke.

* * * * *